US007096626B2

(12) United States Patent
Heng et al.

(10) Patent No.: US 7,096,626 B2
(45) Date of Patent: Aug. 29, 2006

(54) SASH MOUNTED HOUSING WITH COLLAPSIBLE RETAINERS

(75) Inventors: Liu Heng, Taipei (TW); Yi Cheng Hsiung, Hsin Tien (TW)

(73) Assignee: International Product Sources, Inc., Pembroke Pines, FL (US)

( * ) Notice: Subject to any disclaimer, the term of this patent is extended or adjusted under 35 U.S.C. 154(b) by 0 days.

(21) Appl. No.: 10/376,998

(22) Filed: Feb. 28, 2003

(65) Prior Publication Data

US 2004/0168369 A1 Sep. 2, 2004

(51) Int. Cl.
*E05D 15/22* (2006.01)

(52) U.S. Cl. ..... 49/185; 49/183; 49/449; 292/175

(58) Field of Classification Search ..... 49/446, 49/181, 185, 184, 183, 449; 292/175, DIG. 47
See application file for complete search history.

(56) References Cited

U.S. PATENT DOCUMENTS

| | | | | | |
|---|---|---|---|---|---|
| 3,841,674 | A | * | 10/1974 | Bisbing et al. | 292/175 |
| 4,475,311 | A | | 10/1984 | Gibson | |
| 4,553,353 | A | | 11/1985 | Simpson | |
| 4,578,903 | A | | 4/1986 | Simpson | |
| 4,622,778 | A | | 11/1986 | Simpson | |
| 4,669,765 | A | | 6/1987 | Ullman | |
| 4,790,579 | A | | 12/1988 | Maxwell et al. | |
| 4,791,756 | A | | 12/1988 | Simpson | |
| 4,824,154 | A | | 4/1989 | Simpson | |
| 4,837,975 | A | | 6/1989 | Simpson | |
| 4,901,475 | A | | 2/1990 | Simpson | |
| 4,923,230 | A | * | 5/1990 | Simpson | 292/67 |
| 5,028,083 | A | | 7/1991 | Mischenko | |
| 5,139,291 | A | | 8/1992 | Schultz | |
| 5,669,639 | A | * | 9/1997 | Lawrence | 292/175 |
| 5,671,958 | A | | 9/1997 | Szapucki et al. | |
| 5,806,900 | A | * | 9/1998 | Bratcher et al. | 292/137 |
| 5,829,196 | A | | 11/1998 | Maier | |
| 5,970,656 | A | | 10/1999 | Maier | |
| 5,996,283 | A | | 12/1999 | Maier | |
| 6,021,603 | A | * | 2/2000 | Prete et al. | 49/183 |
| 6,178,696 | B1 | * | 1/2001 | Liang | 49/185 |
| 6,183,024 | B1 | * | 2/2001 | Schultz et al. | 292/175 |
| 6,485,070 | B1 | * | 11/2002 | Schultz | 292/175 |
| RE37,916 | E | | 12/2002 | Szapucki et al. | |
| 6,604,324 | B1 | * | 8/2003 | Maier | 49/181 |
| 6,722,712 | B1 | * | 4/2004 | Schultz | 292/175 |
| 6,832,792 | B1 | * | 12/2004 | Polowinczak et al. | 292/36 |
| 2004/0128916 | A1 | * | 7/2004 | Fullick | 49/449 |

* cited by examiner

*Primary Examiner*—Gregory J. Strimbu
(74) *Attorney, Agent, or Firm*—Edwards Angell Palmer & Dodge LLP

(57) ABSTRACT

A tilt latch and pivot housing which has a collapsible retainer on each of its side walls extending along a substantial portion of the length thereof and angularly outwardly from the side walls of the housing. The inner surface of each retainer is spaced from the surface of the adjacent side wall of the housing, thus forming a crevice or gap designed to receive the retainer when sufficient pressure is applied to the retainer's outer surface causing the retainer to deflect inwardly. According to some embodiments, portions of the retainers adjacent to the upper engagement ends therof are beveled. The retainers may also be beveled on one end to facilitate installation of the housing into a sash. The housing may also include a collapsible retainer formed at the bottom wall of the housing for preventing longitudinal movement of the housing after installation. The present invention is also directed to methods of manufacturing sash windows having tilt latches and/or pivots incorporating the housings.

19 Claims, 5 Drawing Sheets

5

6
12
11
8
18
18
20
10
20
9
7
9
14
10
16
14
16

SASH MOUNTED HOUSING WITH COLLAPSIBLE RETAINERS

BACKGROUND OF THE INVENTION

1. Field of the Invention

The subject invention relates to the field of window hardware, and specifically, to a tilt latch and pivot housing having outwardly projecting deflectable retainers that can be collapsed inwardly for installation in a sash window.

2. Background of the Related Art

A double-hung window assembly usually includes a window frame and a pair of window sashes mounted for reciprocal vertical movement. The window sashes are pivotally supported in the window frame. Vertical movement of the window sashes along the vertical slide channels formed in the jambs of the window frame is maintained by tilt latch mechanisms located at opposed corners of the window sashes. The latch mechanisms include latch bolts or sliders that can be moved along the slide channels and which, while engaged in the slide channels, prevent pivoting of the window sashes. When the latch bolt is retracted from the slide channel, the window sash can be pivoted on suitably installed pivot mechanisms. A pivot assembly for a sash window includes a rigid body and a pivot bar projecting from the body. Each pivot bar has an end adapted for being received in a brake assembly.

A sash window tilt latch usually includes a housing having an outward end opening, within which the bolt or slider is disposed. A spring contained in the housing forces the latch bolt through the outward end opening to engage the slide channels. A control knob is coupled to the latch bolt and extends upward through an elongated opening in the upper surface of the housing. The control knob permits selective inward movement of the latch bolt to release the latch bolt from the respective slide channel.

Sash window tilt latches can be surface mounted on the top rail portion of a sash, as shown, for example, in U.S. Pat. Nos. 4,837,975 and 4,901,475 to Harold Simpson, assigned to Ashland Products. Latches thus installed, however, are not considered aesthetically pleasing and have a tendency to fail due to repeated collisions with the header of the window frame. Accordingly, it has proved to be more advantageous to mount tilt latches substantially within the sash. Such flush-mounted tilt latches are disclosed, for example, in U.S. Pat. Nos. 4,553,353, 4,578,903, 4,622,778, and 4,791,756 to Harold Simpson, assigned to Ashland Products. The described latches, however, have complicated configurations and are relatively difficult to assemble.

U.S. Pat. Nos. 5,996,283 ("the '283 patent"), U.S. Pat. No. 5,970,656 ("the '656 patent"), and U.S. Pat. No. 5,829,196 ("the '196 patent") to Robert G. Maier, assigned to Ro-Mai Industries, Inc., U.S. Pat. No: 5,139,291 ("the '291 patent") to Steven E. Schultz, assigned to Ashland Products, and U.S. Pat. No. 5,671,958 ("the '958 patent") to Matthew P. Szapucki et al. describe tilt latch and/or pivot housings that can be more easily installed into sash windows. The housing described in the '291 patent has a side wall rail on each of its side walls. The installation of the housing into a suitably sized slot formed in a window sash is accomplished by inserting the housing longitudinally into the side opening of the slot so that the side wall rails are received in the matching cutouts in the side opening. Similarly, the pivot housing described in the '196 patent has a pair of channels, while the lower end of the sash is cut to define a pair of opposing rails. When the pivot housing is installed into the sash, the rails are received in the channels.

The '283 patent describes a tilt latch or a pivot housing assembly wherein protuberances are used in place of rail-shaped structures described in the '291 and the '196 patents for retaining the housing within the sash. The housing described in the '283 patent is installed into the sash by aligning the housing with the side opening of a slot cut in the sash and moving the housing longitudinally so that the edges of the slot are received in the gaps defined by the housing's flange and the protuberances on the side walls of the housing. Alternatively, the housing can be installed by aligning it with the top opening of a slot cut in the sash and then forced downwardly, so that the protuberances move past the edges of the slot and the edges are received in the gaps defined by the housing's flange and the protuberances.

The '656 patent describes a tilt latch or pivot housing having retainers along each of its sides that are capable of engaging the edges of a slot in a window sash, similar to the function performed by the protuberances described in the '283 patent. The retainers described in the '656 patent are flared upwardly and beveled rearwardly to facilitate their installation longitudinally or vertically.

The '958 patent describes a latch housing that snaps firmly into position when forced perpendicularly through an elongated opening in the top of a sash. The walls of the housing each have resilient tabs extending outwardly from the walls of the housing, that are pushed inwardly as the housing is forced through the elongated opening and snap outwardly to secure the housing within the sash. The tab's capability to be pushed inwardly is achieved by providing windows behind the tabs. The walls of the housing also have longitudinal slots for passing wings extending from a bolt disposed within the housing.

The prior art approaches to installation of a tilt latch or pivot housing into a window sash have various disadvantages that are overcome by the present invention. For example, a housing constructed according to the '291 or the '196 patent can be installed into a sash only from the side of the sash, while the housing of the present invention can be installed either from the side or from the top of the sash. Further, in the housing assemblies of the '291, the '196 and the '283 patents, the slots for receiving the housings are formed either by a single router in three steps or by two different routers. In contrast, when the housing according to the present invention is used, the matching slot in a sash can be formed in one step using a single router.

Finally, the '291, the '196, the '283 and the '656 patents all disclose retainers that are not movable with respect to the body of the housing. Therefore, when the housing is installed as shown in the '283 and in the '656 patents, the retainers (or protuberances) are likely to break off and the housing is likely to be deformed. This is avoided by the present invention through the use of a housing having retainers that can be deflected or collapsed inwardly. The housing having resilient tabs, as described in the '958 patent, also has various shortcomings that are improved in the housing according to the present disclosure. For example, the housing of the '958 patent has a longitudinal slot in each of the side walls, which leaves less space for the tabs, thus increasing the possibility that the tabs would break off during installation. Furthermore, due to their structural differences, the tabs of the '958 patent are less durable than the deflectable retainers of the present disclosure.

Accordingly, the present invention is directed to a tilt latch and a pivot housing having an outwardly projecting deflectable retainer on each of its walls, that can be collapsed inwardly for installation in a sash window, each retainer extending along a substantial portion of the length of the housing. The retainers may be beveled on one end to facilitate their installation.

The present invention is further directed to a tilt latch and a pivot housing that includes a bottom retainer or tab protruding from the bottom wall of the housing for engaging the inner surface of a sash. While the prior art discloses non-movable retaining tabs at the bases of tilt latch or pivot housings, the construction of the tab of the present invention is more advantageous due to its capability to retract during installation. Such construction helps avoid breaking off the tab and reduces deformation of the housing.

Finally, the present invention is directed to methods of manufacturing sash windows having tilt latches and/or pivots incorporating housings according to the present invention.

SUMMARY OF THE INVENTION

The subject invention is directed to a housing for installation into a slot formed in a window sash. The housing includes at least two side walls and a top wall extending beyond the side walls to define a flange. According to one embodiment of the invention, the housing has one deflectable retainer projecting angularly away from the lower edge of each of the housing's walls and extending over a substantial portion of the length of the side walls. Each retainer defines an upper engagement end that is spaced from the undersurface of the flange to accommodate reception of the opposed edges of the slot upon inward deflection of the retainers during installation. The upper engagement end may comprise a surface spaced from and generally parallel to the undersurface of the flange, when no pressure is applied to the retainer and the retainer is not deflected. A portion of the retainer that is adjacent to the upper engagement end may be beveled. The retainers may be beveled on one end as well.

According to another embodiment of the present invention, the housing has a plurality of deflectable retainers projecting angularly away from the lower edge of each of the housing's walls and together extending over a substantial portion of the length of the side walls. Each retainer defines an upper engagement end that is spaced from the undersurface of the flange to accommodate reception of the opposed edges of the slot upon inward deflection of the retainers during installation. A portion of the retainer that is adjacent to the upper engagement end is beveled. The upper engagement end may comprise a surface spaced from and generally parallel to the undersurface of the flange, when no pressure is applied to the retainer and the retainer is not deflected. The retainers may also be beveled on one end.

A housing according to the present invention may further include a bottom wall and a collapsible retainer formed at the bottom wall of the housing. The bottom retainer sinks into the housing when pressure is applied to its outer surface. After the housing is installed, the bottom retainer engages the wall of the stile.

According to one of the embodiments, a housing according to the present invention can be incorporated into a pivot assembly. This is accomplished by providing a pivot bar within the housing. The pivot bar projects from the housing and may include laterally extending flanges spaced from the housing.

According to another embodiment, a housing according to the present invention can be incorporated into a tilt latch assembly. This is accomplished by providing a movable bolt within the housing. The movable bolt projects from the housing and may be coupled to a knob projecting through the opening cut in the top wall of the housing.

The present invention is also directed to a method of manufacturing a sash window that includes the steps of forming a pair of opposed longitudinal slots in a top rail of the window sash, each slot having a pair of opposed edges, and providing a pair of tilt latches, each tilt latch including a housing comprising side walls having collapsible retaining means for retaining the housing within the slot. The tilt latches are then inserted into the respective slots in the top rail.

The present invention is further directed to a method of manufacturing a sash window that includes the steps of forming a pair of opposed longitudinal slots in a bottom rail of the window sash, each slot having a pair of opposed edges, and providing a pair of pivots, each pivot including a housing comprising side walls having collapsible retaining means for retaining the housing within the slot. The pivots are then inserted into the respective slots in the bottom rail.

According to any of the methods of the present invention, the housings can be inserted into the slots in a window sash along the longitudinal axes of the slots.

Alternatively, the housings can be inserted along the axes transverse to the longitudinal axes of the slots.

These and other aspects of the tilt latch and pivot housing of the present invention and the methods of manufacturing a sash window including tilt latches and/or pivots incorporating housings according to the present invention will become more readily apparent to those having ordinary skill in the art from the following detailed description of the invention taken in conjunction with the drawings provided hereinbelow.

BRIEF DESCRIPTION OF THE DRAWINGS

So that those having ordinary skill in the art to which the present invention pertains will more readily understand how to make and use the housing assembly of the present invention, embodiments thereof will be described in detail below with reference to the drawings, wherein.

DETAILED DESCRIPTION

Figure 1:
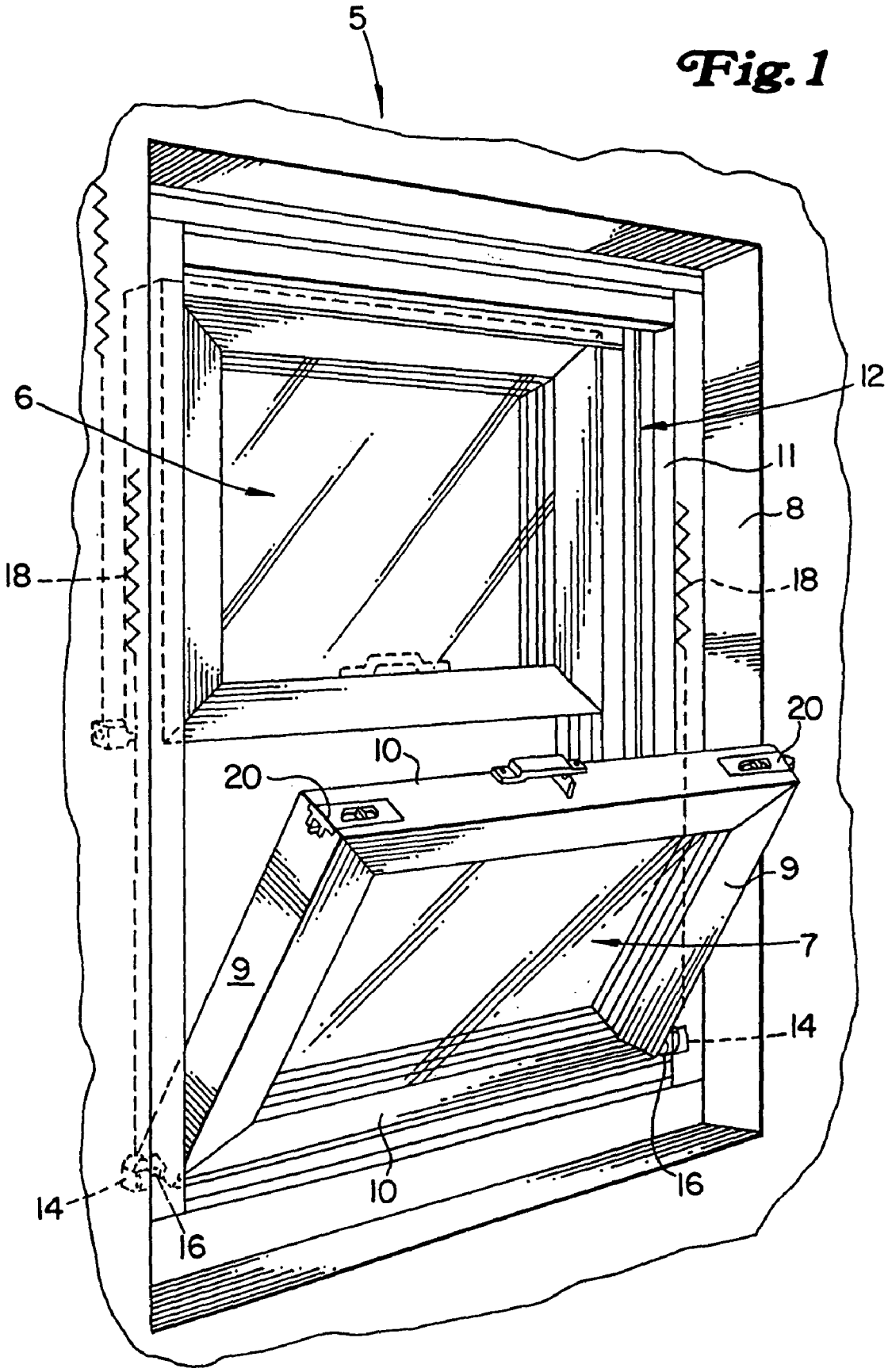
FIG. 1 is a perspective view of a double hung window assembly constructed according to the present invention, which includes the novel tilt latch and pivot housing of the present invention.

Referring now to the drawings wherein like reference numbers identify similar aspects of the invention, there is illustrated in FIG. 1 a double hung window assembly 5 including an upper sash 6 and a lower sash 7 that are slidable in a window frame 8. The lower sash 7, for example, includes vertically oriented stiles 9 and horizontally oriented rails 10 constituting a header (upper) rail and a footer (lower) rail. The window frame 8 includes jambs 11 defining opposed vertical slide channels or tracks 12. Brake assemblies 14 are slidable in the respective slide channels 12. Lower corners of the sash 7 are provided with pivot assemblies 16 that are associated with the respective brake assemblies 14. The brake assemblies 14 are supported by respective counterbalances, such as balance springs 18 disposed in the slide channels 12. Tilt latches 20 are disposed in upper corners of the sash 7 for releasably retaining the upper end of the sash in the slide channels 12.

Referring to FIGS. 2A, 2B, 2C and 2D there are illustrated different embodiments of a housing 30 according to the present invention, which can be incorporated into the pivot assembly 16, the tilt latch assembly 20, or both. The housing 30 includes a planar bottom wall 32, side walls 34*a*, 34*b*, a rear wall 36, and a top wall 38, defining a hollow cavity 31 opening at a front end of the housing. The top wall 38 defines an outwardly extending flange 33 at the top of the side and rear walls 34*a*, 34*b* and 36.

Collapsible or deflectable retainers 35*a* and 35*b* extend from and along a substantial portion of the length of each of the side walls 34*a*, 34*b* of the housing 30, respectively. The term "along a substantial portion of" as used herein, means that the deflectable retainers 35*a*, 35*b* extend over about 30% or more of the length of the side walls 34*a*, 34*b* of the housing 30. The retainers 35*a*, 35*b* are sloped generally outwardly and in an upward direction from the bottom edges of the side walls 34*a*, 34*b*, terminating at upper engagement ends 37*a*, 37*b* spaced from the undersurface of the flange 33. The inner surfaces 73*a*, 73*b* of each retainer 35*a*, 35*b* are spaced from the adjacent wall 34*a*, 34*b*, respectively, of the housing 30, thus forming gaps or crevices designed to receive the retainers when sufficient pressure is applied to the retainer's outer surfaces 71*a*, 71*b*, causing the retainer to deflect or collapse inwardly. Portions 76 of retainers 35*a*, 35*b* that are adjacent to the engagement ends 37*a*, 37*b* may be beveled to facilitate installation of the housing into the sash and to improve durability of the retainers. In addition, the retainers 35*a* and 35*b* may be beveled as shown in FIG. 2C. According to this embodiment, the end of each retainer 35*a*, 35*b* adjacent to the rear wall 36 is sloped to form a wedge 74 to facilitate installation of the housing into the sash.

The shape of the retainers 35*a*, 35*b* may vary, for example, depending on the dimensions of the window sash and housing. Preferably, the retainers 35*a*, 35*b* are collapsible wings flaring outwardly from the side walls 34*a*, 34*b*. In the embodiments shown in FIGS. 2A and 2C, the housing has one retainer at each of its side walls.

Figure 2A:
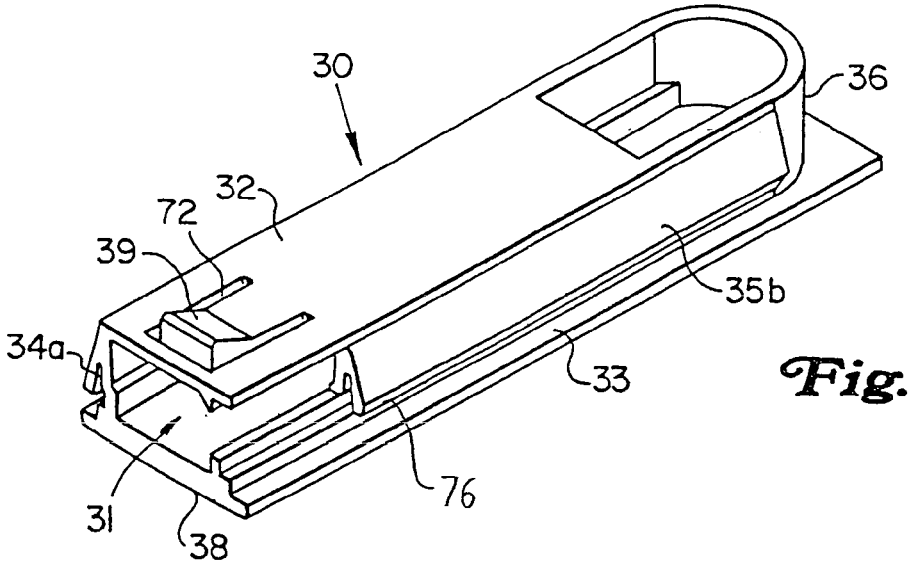
FIG. 2A is a perspective view of a housing according to one embodiment of the present invention.
Figure 2B:
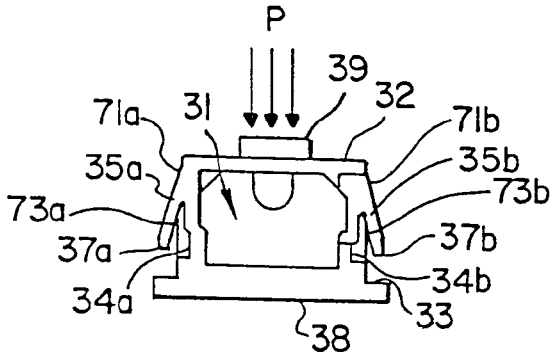
FIG. 2B is a front view of the housing shown in FIG. 2A.
Figure 2C:
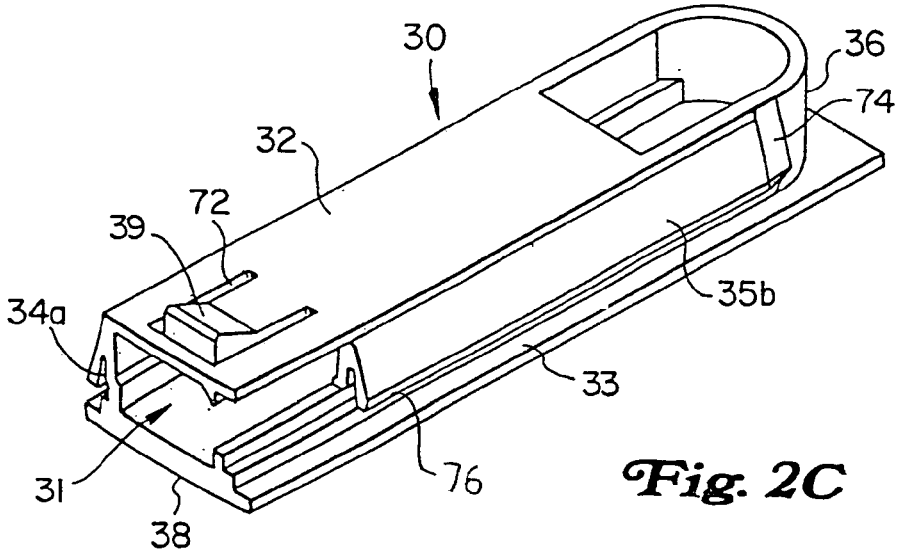
FIG. 2C is a perspective view of a housing according to another embodiment of the present invention.
Figure 2D:
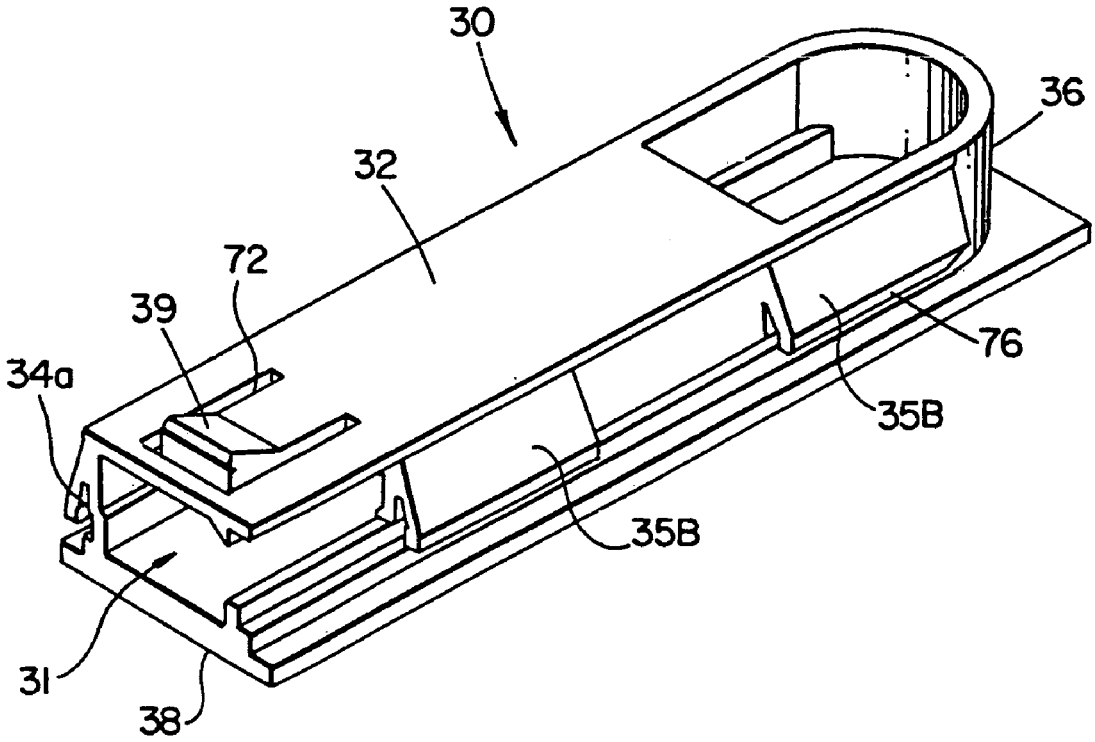
FIG. 2D is a perspective view of a housing according to another embodiment of the present invention.

FIG. 2D, on the other hand, shows an embodiment of the present invention, in which the housing has two retainers at each of its side walls. In this embodiment, the retainers also extend along a substantial portion of the length of each of the side walls, and portions 76 of retainers 35*a*, 35*b* that are adjacent to the engagement ends 37*a*, 37*b* may be beveled to facilitate installation of the housing into the sash and to improve durability of the retainers.

The bottom wall 32 of the housing may include a bottom retainer 39 for engaging behind the stile 9 adjacent the bottom edge 44 (see FIGS. 2A and 2B). According to the present invention, the bottom retainer 39 is also collapsible. This is accomplished by providing a cutout 72 in the bottom wall 32 around the retainer 39. When pressure is applied to the bottom retainer as generally shown by arrows P in FIG. 2B, the bottom retainer sinks into the hollow cavity 31 of the housing to aid the installation of the housing into the sash.

Figure 3A:
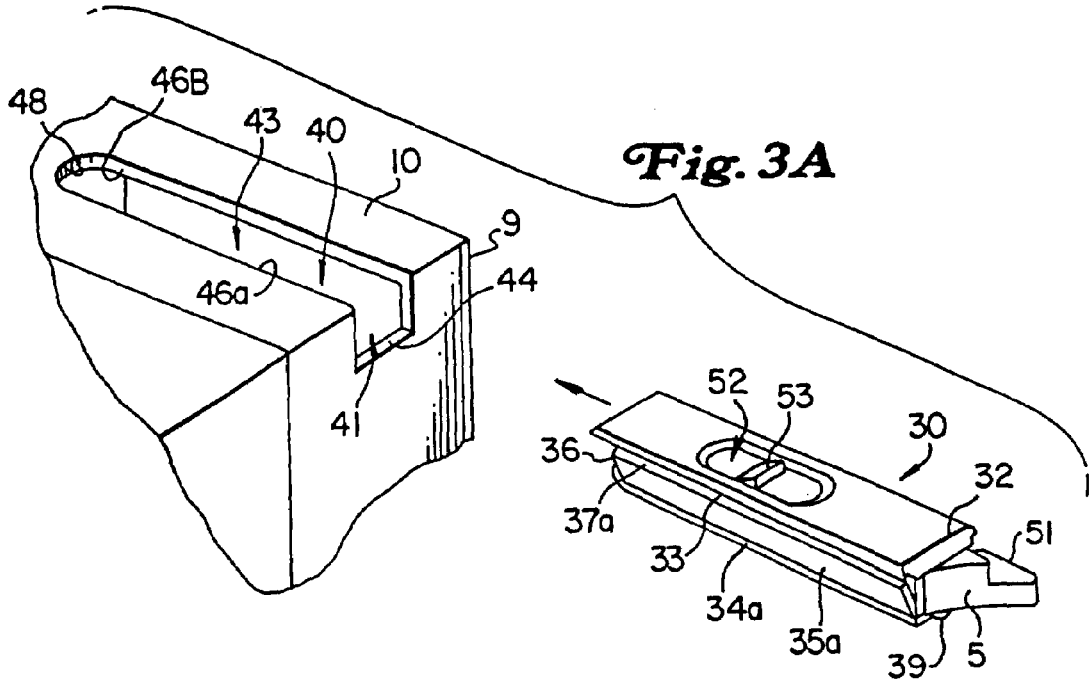
FIG. 3A is a perspective view of a tilt latch assembly incorporating a housing of the present invention.
Figure 3B:
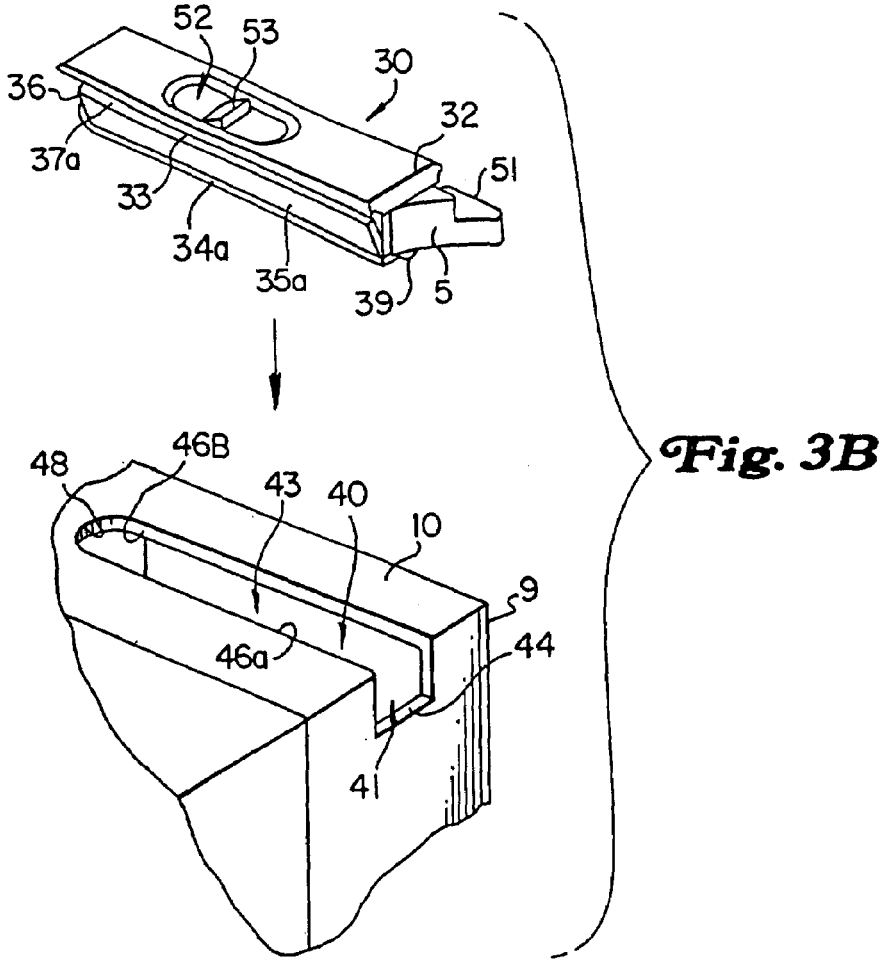
FIG. 3B illustrates transverse insertion of the housing of the present invention into a slot formed in a window sash.

The housing 30 is configured to be inserted into an elongated slot 40 in the top rail 10 of a window sash, shown in FIGS. 3A and 3B, either longitudinally (FIG. 3A) or transversely (FIG. 3B). When the housing 30 is to be installed into the matching slot longitudinally, the rear end of the housing is placed adjacent the opening 41 of the slot in the stile 9. The housing 30 is then moved longitudinally while applying pressure to the retainers 35*a*, 35*b* in order to collapse them inwardly, so that the flange 33 would remain above and in contact with the edges 46*a*, 46*b* of the slot 40. Once the housing 30 is installed into the slot 40, the retainers 35*a*, 35*b* return to an outwardly projected orientation so that the edges 46*a*, 46*b* of the slot 40 are secured between the engagement ends 37*a*, 37*b* of the retainers 35*a*, 35*b* and the flange 33. If a bottom retainer 39 is provided at the bottom wall of the housing, upon the proper installation of the housing, the bottom retainer 39 engages the wall of the stile 9 adjacent to the bottom edge 44.

Alternatively, the housing 30 may be installed transversely into the slot 40, as shown in FIG. 3B. In this case, the rear wall 36 of the housing 30 is placed against the rear edge 48 of the opening 43 so that the rear edge 48 is below the flange 33. The housing is then forced downwardly while applying pressure to the retainers 35*a*, 35*b* in order to collapse them inwardly. Once the retainers 35*a*, 35*b* move past the edges 46*a*, 46*b*, they are released and the edges 46*a*, 46*b* are secured between the engagement surfaces 37*a*, 37*b* of the retainers 35*a*, 35*b* and the flange 33. If the bottom retainer 39 is provided on the bottom wall 32, upon proper installation it engages the wall of the stile 9 adjacent to the bottom edge 44.

A housing constructed according to the present invention may be incorporated into a tilt latch assembly 20. For example, FIG. 3A shows such a tilt latch assembly, which includes a housing 30 and a movable bolt 51 projecting therefrom. The bolt 51 is slidably disposed in the cavity 31 of the housing. The housing 30 is sized to fit in the opening 41 in the stile 9 so that the bolt 51 extends outwardly from the stile. A spring (not shown) disposed inside the housing forces the bolt 51 forward to an extended position. A knob 53, provided on the top surface of the bolt 51, projects through a slot 52 in the top wall 32 of the housing. A nose 55 of the bolt is adapted for engaging in the slide channel 12 (see FIG. 1) for retaining the sash in the window frame. The sash is releasable by use of the knob 53 to retract the bolt 52 thereby disengaging the nose 55 from the channel 12.

Figure 4:
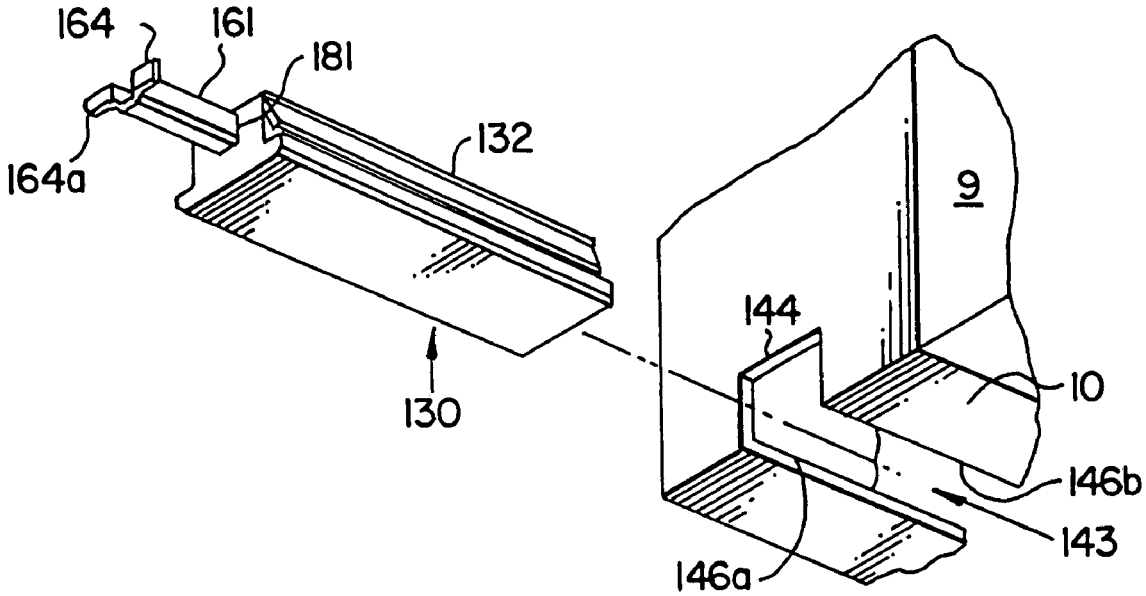
FIG. 4 is a perspective view of a pivot assembly incorporating a housing of the present invention.

A housing constructed according to the present invention also may be incorporated into the pivot assembly 16. FIG. 4 shows such a pivot assembly including a housing 130 with a pivot bar 161 located therein. The housing 130 includes a body 132 having a longitudinal bore 181. The bore 181 is configured to retain snugly the pivot bar 161 therein. One end of the pivot bar is provided with laterally extending flanges 164*a*, 164*b* for securing the pivot assembly 16 to the break assembly 14. Another end of the pivot bar 161 is provided with a retainer (not shown) for restricting longitudinal movement of the pivot bar. The pivot bar projects from the housing 130 so that the flanges are spaced from the housing.

Although the present disclosure describes several embodiments of the subject invention, those skilled in the art will appreciate that changes and modifications may be made thereto without departing from the spirit and scope of the present invention.

The invention claimed is:

1. A housing for installation in a window sash having a slot defining a pair of opposed edges, the housing comprising:

a) opposed side walls each having upper and lower edges and extending generally parallel to a longitudinal axis of said housing;

b) a top wall extending along and beyond the upper edges of the opposed side walls to define a flange;

c) a deflectable retainer connected with and projecting angularly away from the lower edge of each of the side walls and extending along a majority of the length of each of the side walls, each retainer having a distal free upper engagement end, such that a gap is provided between the upper engagement end of each retainer and an undersurface of the flange to accommodate reception of the opposed edges of the slot upon inward deflection of the retainers during installation, of the housing in the slot wherein the distal free upper engagement end of each deflectable retainer defines a gap between each retainer and the side wall to which the retainer is connected, and wherein the side walls, top wall and retainers constitute a one-piece monolithic structure; and d) a movable bolt disposed between and slidable generally parallel to said opposed side walls.

2. The housing as recited in claim 1, wherein the upper engagement end of each retainer in an undeflected position comprises a surface spaced from and generally parallel to the undersurface of the flange.

3. The housing as recited in to claim 1, further comprising a bottom wall, wherein the side walls, the top wall and the bottom wall define a hollow cavity.

4. The housing as recited in claim 3, further comprising said movable bolt projecting from of the housing.

5. The housing as recited in claim 4, wherein the top wall of the housing has an opening and wherein the movable bolt is coupled to a knob projecting through the opening.

6. The housing as recited in claim 3, further comprising a deflectable retainer formed at the bottom wall of the housing for preventing longitudinal movement of the housing after installation.

7. The housing as recited in claim 1, further comprising a bottom wall and a rear wall, wherein the side walls, the top wall, the bottom wall and the rear wall define a hollow cavity with an opening at a front end of the housing.

8. The housing as recited in claim 7, further comprising, said movable bolt projecting from the front end of the housing.

9. The housing as recited in claim 8, wherein the top wall of the housing has an opening and wherein the movable bolt is coupled to a knob projecting through the opening of the top wall.

10. The housing as recited in claim 1, wherein the deflectable retainers each have a front end and a rear end and wherein the rear end of each retainer is beveled.

11. The housing of claim 1, wherein each retainer defines an inner surface spaced from the side wall to which the retainer is connected to form the gap between the retainer and the side wall to which the retainer is connected, wherein the gap between each retainer and the side wall to which the retainer is connected is designed to receive a respective one of the retainers when sufficient pressure is applied to the outer surface of the respective one of the retainers.

12. A housing for installation in a window sash having a slot defining a pair of opposed edges, the housing comprising:

a) at least two side walls each having a rear end and a front end and extending generally parallel to a longitudinal axis of said housing;

b) a top wall extending beyond the side walls to define a flange and extending along the side walls toward the rear and front ends of the side walls;

c) collapsible retaining means attached to each side wall, projecting angularly away from a lower edge of each side wall, and extending along a majority of the length of each side wall for retaining the housing within the slot, each retaining means having a distal free upper engagement end, wherein the distal free upper engagement end of each retaining means defines a gap between the retaining means and the side wall to which the retaining means is attached and a gap between the retaining means and the flange, and wherein the side walls, top wall and retaining means are a one-piece monolithic structure; and d) a movable bolt disposed between and slidable generally parallel to said walls.

13. The housing as recited in claim 12, wherein the collapsible retaining means comprise engagement surfaces spaced from and generally parallel to the flange for receiving the opposed edges therebetween.

14. The housing as recited in claim 13, further comprising a bottom wall and a rear wall, wherein the side walls, the top wall, the bottom wall and the rear wall define a hollow cavity with an opening at a front end of the housing.

15. The housing as recited in claim 14, further comprising said movable bolt projecting from the front end of the housing.

16. The housing as recited in claim 15, wherein the top wall of the housing has an opening and wherein the movable bolt is coupled to a knob projecting through the opening of the top wall.

17. The housing as recited in claim 12, further comprising a bottom wall, wherein the side walls, the top wall and the bottom wall define a hollow cavity.

18. The housing as recited in claim 17, further comprising at the bottom wall collapsible means for retaining the housing within the slot.

19. The housing of claim 12, wherein each retaining means defines an inner surface spaced from the side wall to which the retaining means is attached to form the gap between the retaining means and the side wall, to which the retaining means is attached, wherein each gap between the retaining means and the side wall to which the retaining means is attached is designed to receive a respective one of the retaining means when sufficient pressure is applied to the outer surface of the respective one of the retaining means.

* * * * *